US007481429B2

(12) United States Patent
Eckart et al.

(10) Patent No.: US 7,481,429 B2
(45) Date of Patent: Jan. 27, 2009

(54) METHOD FOR THE CYCLIC CONVEYANCE OF SHEETS THROUGH A PRINTING MACHINE

(75) Inventors: Thorsten Eckart, Ilvesheim (DE); Michael Füner, Karlsruhe (DE); Peter Hachmann, Dossenheim (DE); Karl-Heinz Helmstädter, Heidelberg (DE); Andreas Detloff, Walldorf (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 317 days.

(21) Appl. No.: 11/314,644

(22) Filed: Dec. 21, 2005

(65) Prior Publication Data

US 2007/0006754 A1 Jan. 11, 2007

(30) Foreign Application Priority Data

Dec. 21, 2004 (DE) ..... 10 2004 061 410

(51) Int. Cl.
*B65H 5/08* (2006.01)

(52) U.S. Cl. ..... 271/275; 271/276

(58) Field of Classification Search ..... 271/275, 271/276, 277

See application file for complete search history.

(56) References Cited

U.S. PATENT DOCUMENTS

| | | | | |
|---|---|---|---|---|
| 4,395,949 | A | 8/1983 | Jeschke | |
| 5,186,105 | A * | 2/1993 | Emrich et al. | 101/217 |
| 5,582,400 | A | 12/1996 | Seydel | |
| 6,889,609 | B2 | 5/2005 | Braun et al. | |
| 2001/0008328 | A1 | 7/2001 | Gunschera et al. | |
| 2001/0018871 | A1 | 9/2001 | Henn | |

FOREIGN PATENT DOCUMENTS

| | | | |
|---|---|---|---|
| DE | 33 28 843 | A1 | 6/1984 |
| DE | 43 28 445 | A1 | 3/1995 |
| DE | 44 35 337 | A1 | 4/1996 |
| DE | 196 34 910 | A1 | 3/1998 |
| DE | 197 30 042 | A1 | 1/1999 |
| DE | 200 02 212 | U1 | 5/2000 |
| DE | 200 08 731 | U1 | 9/2000 |
| DE | 199 60 351 | A1 | 6/2001 |
| DE | 100 03 352 | A1 | 8/2001 |
| DE | 100 38 774 | A1 | 12/2001 |

(Continued)

*Primary Examiner*—Kaitlin S Joerger
(74) *Attorney, Agent, or Firm*—Laurence A. Greenberg; Werner H. Stemer; Ralph E. Locher

(57) ABSTRACT

A method for cyclically conveying sheets through a printing-technological machine adjusts a sheet position with high accuracy. The sheets following one another are in each case held at the front edge in grippers of a gripper system during the conveyance, and wherein the sheet position is adjusted in that a pneumatic apparatus is actuated by a control device which processes signals from at least one fixed-location sensor for the sheet position, as at least one sheet runs past, a large number of measured position values of the sheet are determined successively by using at least one sensor, from the measured position values a characteristic value for the sheet position being determined in the control device, the characteristic value as actual value being compared with a setpoint, and the pneumatic apparatus being set for a following sheet as a function of the comparison in each case between the actual and intended value of the preceding sheet.

11 Claims, 3 Drawing Sheets

FOREIGN PATENT DOCUMENTS

| | | | |
|---|---|---|---|
| DE | 102 05 985 | A1 | 9/2002 |
| DE | 102 16 742 | A1 | 11/2002 |
| DE | 103 12 162 | A1 | 10/2004 |
| EP | 0 016 938 | A1 | 10/1980 |
| EP | 1 155 854 | A2 | 11/2001 |

* cited by examiner 34.1
34.2
Yes
No
35

Yes
No

Yes
No
36

Yes
No
t
t1
t2
t3
t4
t5
t6
t7
t8

METHOD FOR THE CYCLIC CONVEYANCE OF SHEETS THROUGH A PRINTING MACHINE

BACKGROUND OF THE INVENTION

Field of the Invention

The invention lies in the printing technology field. More specifically, the invention relates to a method for the cyclic conveyance of sheets through a printing-technological machine, wherein the sheets following one another are in each case held at the front edge in grippers of a gripper system during the conveyance, and wherein the sheet position is adjusted in that a pneumatic apparatus is actuated by a control device which processes signals from at least one fixed-location sensor for the sheet position.

German patent DE 197 30 042 C2 describes an apparatus for controlling the sheet guidance in a sheet-fed press. There, by using a sensor at a reference point, the actual position of the sheet is determined and compared with an intended position. Depending on the intended-actual difference, actuating elements of a blast air and/or vacuum apparatus aimed at a sheet are actuated, so that, when the sheet is being conveyed on a cylinder, the end of the sheet rests smoothly and completely on the circumferential surface of the cylinder. In the case of controlling the sheet guidance in the feeder of the sheet-fed press, a plurality of sensors can be aimed at various points on the upper side of a sheet stack. Furthermore, rows of sensors can be used as non-contact distance sensors parallel to the edges of a sheet stack. As a result of an uncontrolled movement of a sheet, errors result in measuring the position or the distance, which means that the control of the sheet guidance is inaccurate.

Commonly assigned German published patent application DE 102 05 985 A1 shows a printing material guide element with an integrated distance sensor for sheets. During the conveyance of sheets, the sensor measured values from a specific sensor or an average of measured values from adjacent sensors are indicated to a machine operator. By using the indication, the machine operator can adjust an air flow field.

Commonly assigned U.S. Pat. No. 6,889,609 B2 and German published patent application DE 100 38 774 A1 disclose an apparatus for producing an air stream in a duplicating machine, wherein ion fans are used in order to support a trailing free end of a sheet held in grippers during transport, by means of a specifically adjusted flow field, in such a way that fluttering is reduced. Using a detector, the position of the free end of a sheet is determined and the local intensity of a flow field is varied by a control device such that the position approaches a desired intended position. For the purpose of sheet position detection, optical or ultrasonic sensors can be used, which sense individual points or two-dimensionally.

In the apparatus for conveying sheets onto a stack according to the commonly assigned U.S. Pat. No. 5,582,400 and German published patent application DE 43 28 445 A1, a sensor registering the fluttering movement of the sheets is used. The sensor signals are processed in an open-loop or closed-loop control device to form regulating signals for a blast air or vacuum apparatus.

German published patent application DE 103 12 162 A1 describes a method and apparatus for regulating the sheet position, wherein the lateral sheet contour is recorded by a two-dimensional sensor, in particular by a camera. The sheet contour results from a gray-scale analysis of the image data recorded in a raster. If the sheet contour exceeds a boundary line, actuating elements of a sheet guiding means are activated. A two-dimensional image of the sheet contour can be used only to a limited extent for sheet position regulation, since in real terms the sheet has three-dimensional position deviations, so that position deviations, for example in the center of the sheet, are taken into account only indirectly. A gray-scale analysis is in addition intensive in terms of computing and is less suitable for sheet position regulation in real time.

A press according to German utility model (Gebrauchsmuster) DE 200 08 731 U1 processes in real time the signals from two video cameras aimed at a sheet contour and at the surface of the sheet. From the image data, an actual physical position of the sheet is determined. In comparison with an ideal spatial position, control signals are generated for a device for influencing the sheet run. The control effort is relatively high, with two cameras and a real-time computer. The computing power of the real-time computer limits the maximum possible conveying speed of the sheets.

SUMMARY OF THE INVENTION

It is accordingly an object of the invention to provide a method for cyclically conveying sheets through a printing technology machine which overcomes the above-mentioned disadvantages of the heretofore-known devices and methods of this general type and which makes it possible to keep a sheet on a predefined path with high accuracy.

With the foregoing and other objects in view there is provided, in accordance with the invention, a method for the cyclic conveyance of sheets through a printing machine, the method which comprises:

- holding the sheets, following one another, at a front edge thereof in grippers of a gripper system during the conveyance;
- acquiring a multiplicity of, temporally sequential, measured position values of a sheet running past at least one sensor;
- inputting the measured position values into a control device and determining from the measured position values a characteristic value for the sheet position;
- defining the characteristic value as an actual value, and comparing the actual value with a predefined setpoint value to form a comparison result; and
- adjusting a sheet position of a following sheet by actuating a pneumatic apparatus as a function of the comparison result relating to a respectively preceding sheet.

In other words, according to the invention, a large number of measured position values are determined in the conveying direction of a sheet by using a sensor, from which values a characteristic value for the sheet position is determined. The characteristic value is compared with a predefined intended value, i.e., a setpoint value. Depending on the comparative value, a blast air and/or vacuum apparatus is adjusted, which effects a position correction on a following sheet. The measured position values are preferably derived in a predefined region at the trailing rear edge of a sheet. In the event of a fluctuating sheet length, it is advantageous to define the region from a signal from the sensor at the sheet rear edge. It is advantageous if, in order to determine the characteristic value for the sheet position, the n smallest measured position values are averaged, since smearing is to be prevented. If an ultrasonic sensor is used, then outliers can also be eliminated with this method. A calibration can be made on an area of a gripper system holding the sheet, in order to eliminate a drift in the measuring system as a result of temperature fluctuations or the like.

The blast air and/or vacuum apparatus can be preset by means of a characteristic curve comprising operating points. The characteristic curve reproduces the dependence of the blast air or vacuum on the characteristic value. The operating points can be determined empirically in advance for a limited range of machine settings and/or printing material properties. The characteristic curve can be corrected by using the characteristic values determined from the measured position values.

Other features which are considered as characteristic for the invention are set forth in the appended claims.

Although the invention is illustrated and described herein as embodied in a method for the cyclic conveyance of sheets through a printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
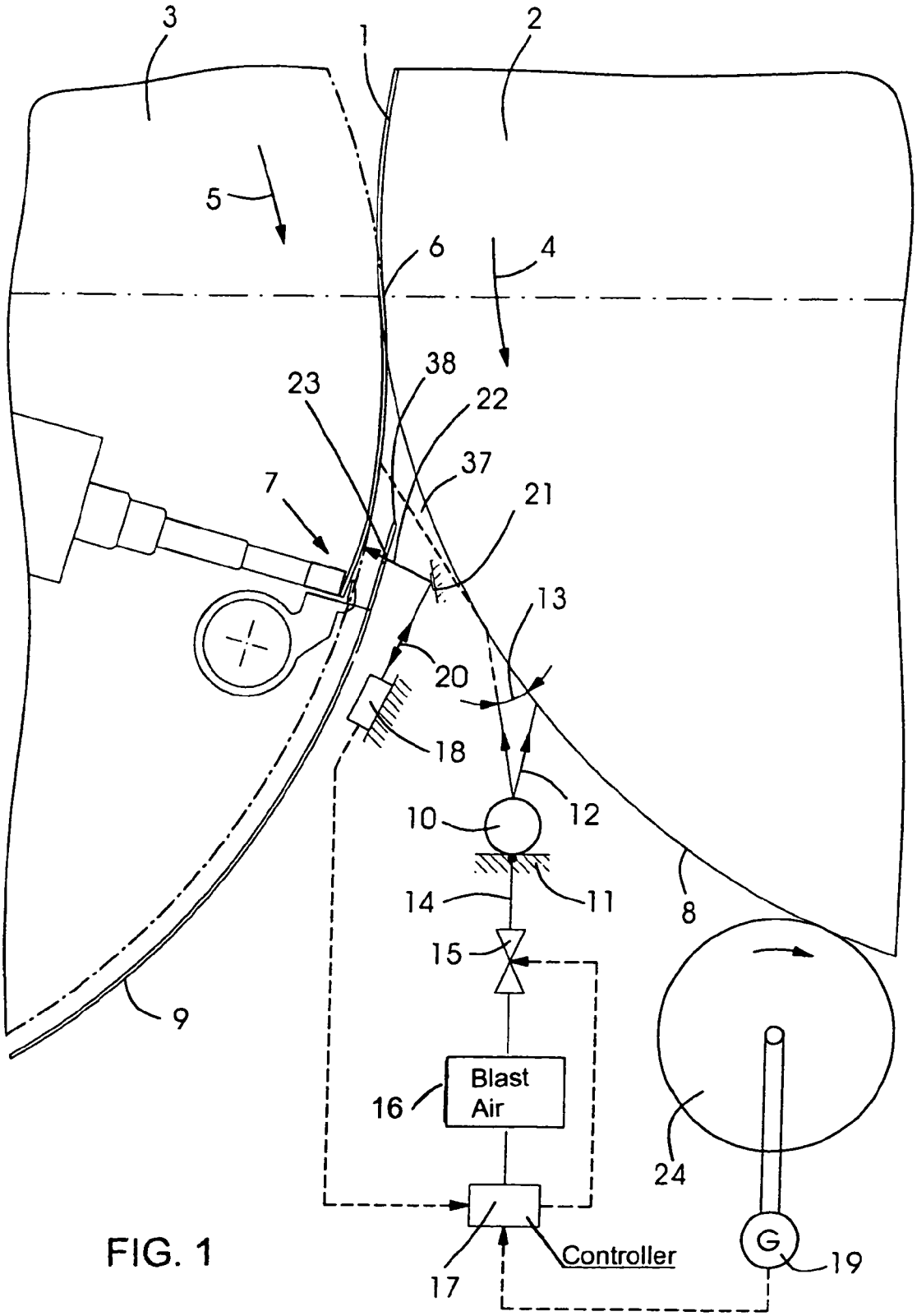
FIG. 1 is a schematic side view of an apparatus for conveying sheets with grippers.

Referring now to the figures of the drawing in detail and first, particularly, to FIG. 1 thereof, there is shown a partial view of an impression cylinder 2 and a transfer drum 3. A sheet 1 is conveyed from the impression cylinder 2 to the transfer drum 3. The impression cylinder 2 and the transfer drum 3 or a delivery chain gripper system rotate synchronously about mutually parallel axes in the directions 4, 5 indicated by arrows. On the transfer line 6, the sheet 1 is picked up at its front edge by a gripper system 7 of the transfer drum 3. During conveyance on the impression cylinder 2, the sheet 1 rests on its circumferential surface 8. By using the gripper system 7, the sheet 1 is held at the front edge and guided freely along a guide plate 9.

If the sheet 1 is freshly printed, it is necessary to prevent the print or the sheet being damaged by contact with the guide plate 9, therefore the sheet 1 is kept floating along the guide plate 9 by pressurized air from a blast air apparatus. The blast air apparatus comprises, inter alia, a blower pipe 10 or a blower box, which is fixed firmly to the frame 11 of the sheet-fed press over the width of the sheet 1. The blower pipe or the blower box 10 has radial air outlet openings, from which a divergent air flow 12 emerges. The airflow 12 strikes the peripheral surface 8 at an acute angle 13. The blower pipe or the blower box 10 is connected to a pressurized air or blast air source 16 by lines 14 and a controllable valve 15.

During the conveyance of a sheet 1, the phase wherein the sheet 1 leaves the transfer line 6 is particularly critical. The trailing end of the sheet 1 is guided freely in this phase and tends to fluttering movements, so there is a risk of collision. In order to ensure that the sheet 1 is kept on a predefined path, an open-loop and closed-loop control apparatus 17 is provided. The open-loop and closed-loop control apparatus 17 is connected to the valve 15 and/or the blast air source 16. Furthermore, the open-loop and closed-loop control apparatus 17 is connected to an ultrasonic sensor 18 and a rotary encoder 19. The ultrasonic sensor 18 contains an ultrasonic transmitter which emits ultrasound waves 20 in the direction of a reflector 21. The reflected beams 22 pass through an opening 23 in the guide plate 9 onto the sheet 1 held in the gripper system 7. The beams 22 reflected back by the sheet 1 reach an ultrasonic receiver of the ultrasonic sensor 18. In principle, it is possible to dispense with the reflector 21 if the circumferential surface 8 of the impression cylinder 1 is used as a reflector for the ultrasound waves 20. The rotary encoder 19 is coupled to a running wheel 24 which is in rolling contact with the circumferential surface 8. The rotary encoder 19 can likewise be coupled directly to the axis of the impression cylinder 1 or another cylinder running synchronously or a drum 3.

Figure 2:
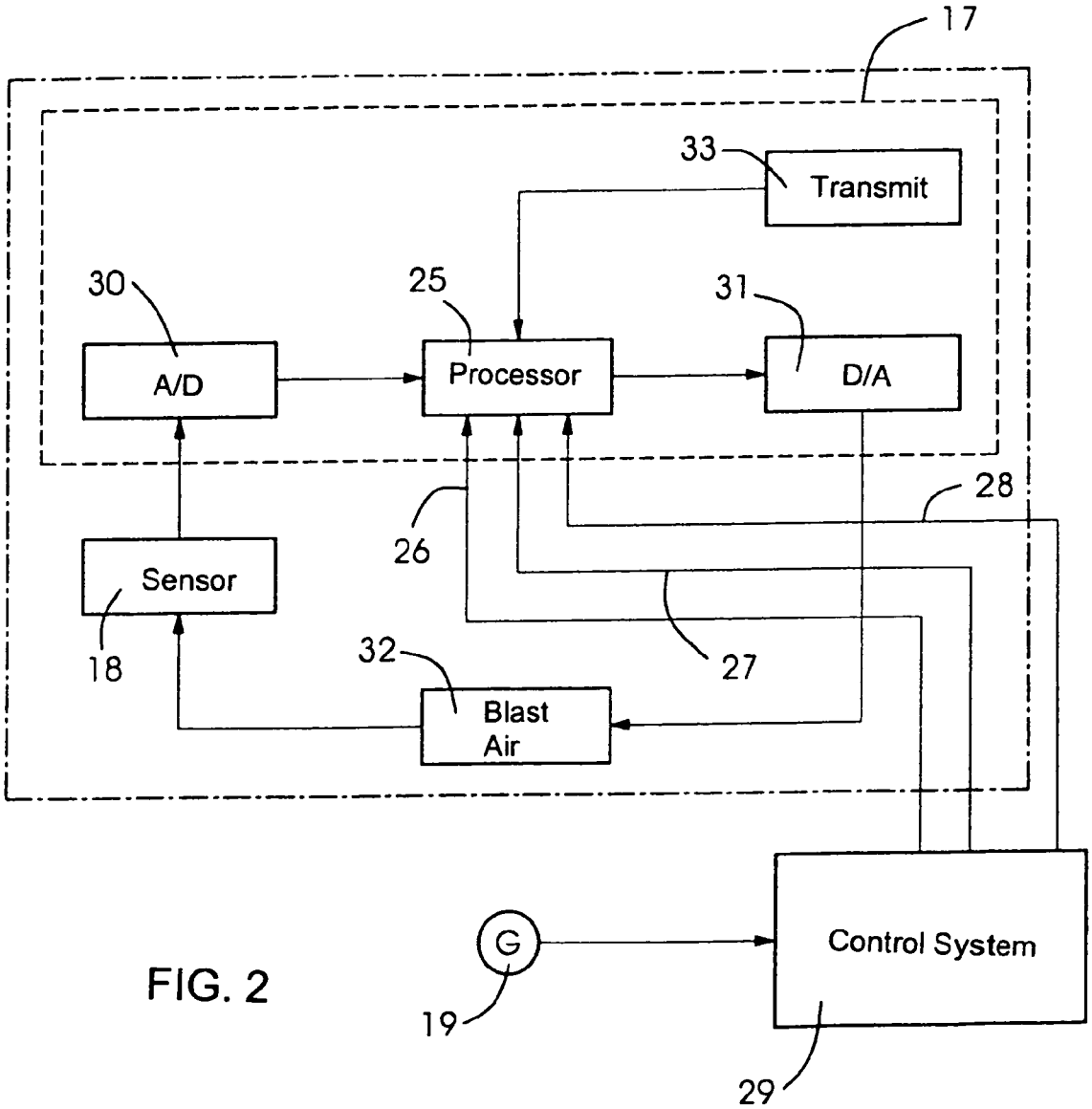
FIG. 2 is a block diagram of a control system for sheet guidance.

The function of the apparatus is best explained with reference to the block diagram according to FIG. 2. The open-loop and closed-loop control apparatus 17 contains a processor or computer 25, which is connected to a control system 29 of the sheet-fed press via lines 26 to 28. In the open-loop and closed-loop control apparatus 17 there is an analog-digital (A/D) converter 30, whose input is connected to the output of the ultrasonic sensor 18. The digitized signals from the ultrasonic sensor 18 pass from the analog-digital converter 30 to the computer 25 to be processed. Connected to the computer 25 is a digital-analog (D/A) converter 31, via which actuating signals pass to a blast air system 32 which, inter alia, comprises the blast air source 16, the controllable valve 15 and the sheet 1. Also assigned to the computer 25 is a transmitter 33 for an intended value of the distance of the sheet 1 from the guide plate 9.

Figures 3, 4, 5, 6:
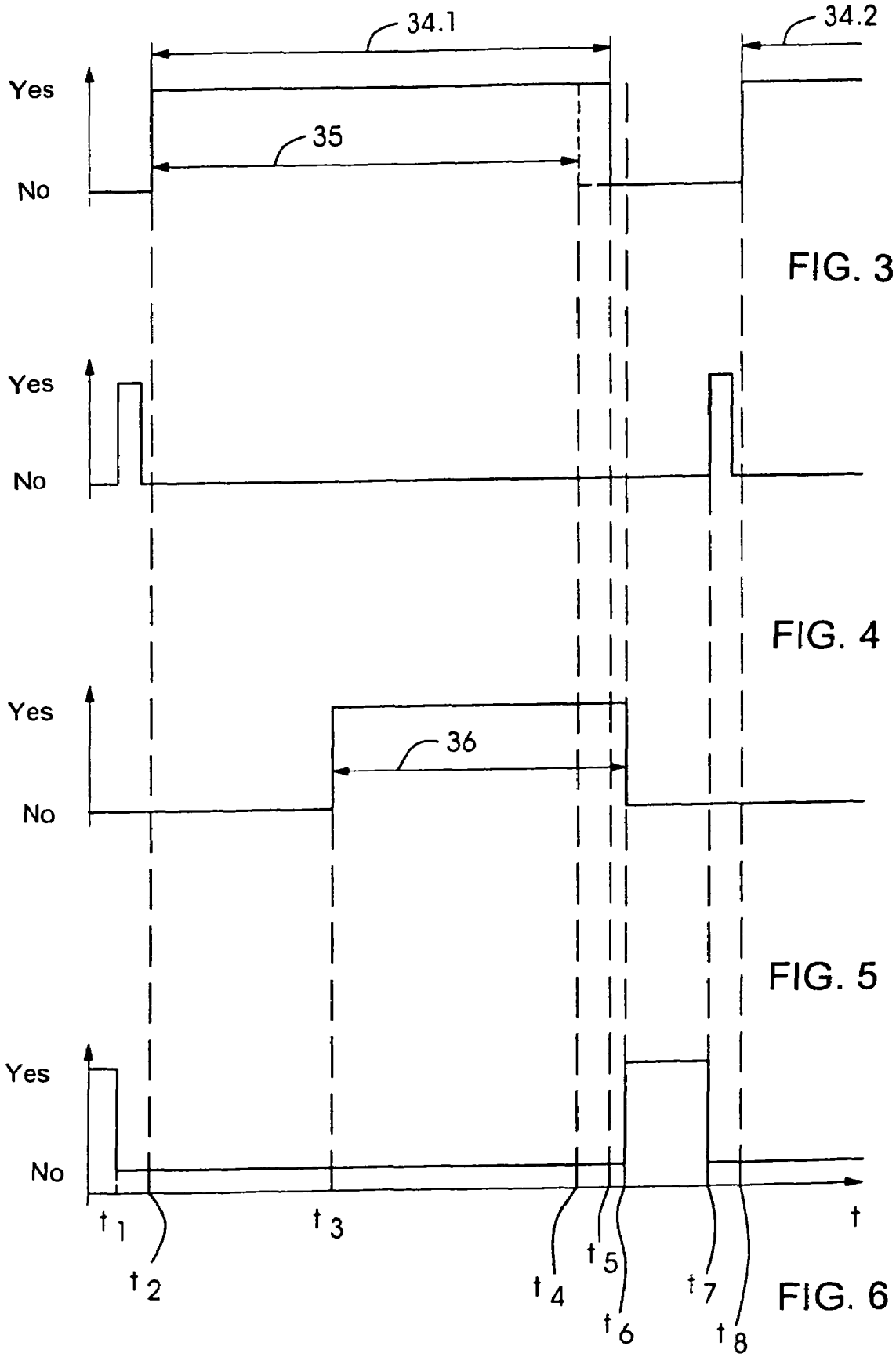
FIGS. 3-6 are diagrams illustrating signal graphs related to signal processing.

In FIG. 3, windows 34.1, 34.2 are illustrated along a time axis t, wherein windows, purely by computation, the sheet 1 is registered by the ultrasonic sensor 18. Since the sheets 1 have different lengths in the transport direction 5, the time period $t_4$-$t_2$ of the window 35 actually available for registering the sheet depends on the time period $t_5$-$t_2$ of the computational window 34. In the case illustrated, the sheet 1 is too short or the sheet 1 is shortened by corrugation. The actual window 35 already ends at $t_4$, before $t_5$ by the time period $t_5$-$t_4$. By using the ultrasonic sensor 18, by means of clocked operation along a line lying in the transport direction, a large number of measured values are obtained which reproduce the distance of the sheet 1 from the guide plate 9 at the respective measurement location. In a predefined rotational position of the transfer drum 3, which results from the evaluation of the signals from the rotary encoder 19, a signal "regulation active" is given to the computer 25 by the control system 29 via the line 26. As emerges from FIG. 6, the regulation is active in a time range of $t_6$-$t_7$, which lies between a time t6 and a time $t_8$, with $t_6 \geqq t_5$ and $t_7 \leqq t_8$. With the signal "regulation active", actuating signals are output to the blast air system 32. The action of the blast air on the sheet 1 can be controlled by adjusting the valve. Therefore, the regulation becomes active at the earliest in the case of the immediately following sheet 1, which can be registered by the ultrasonic sensor 18 at the time $t_8$. In each case immediately before the registration of a sheet 1 by the ultrasonic sensor 18, a reference measurement of the distance to the guide plate 9 from a reference mark on the gripper system 7 is carried out. The measured value processing can therefore be calibrated.

By evaluating the signal from the rotary encoder 19, whose signal is proportional to the rotational angle of the impression cylinder 2 and of the transfer drum 3, the machine control system 29 generates a signal "evaluate measured values" in a time window 36 having the time period $t_6$-$t_3$, which is shown specifically in FIG. 5. Only measured values from the ultrasonic sensor 18 which lie in this time window 36 are evaluated in the computer 25. The start $t_3$ of the time window 36 comes after $t_2$ by an adjustable time $t_3$-$t_2$. Therefore, no measured values which lie in the vicinity of the leading sheet edge are selected. The end of the time window 36 comes at the time $t_6$, at which the rear edge of the sheet 1 has safely passed the ultrasonic sensor 18. The width and the start of the time window 36 therefore depend on the length of the sheet 1 in the transport direction 5.

The ultrasonic sensor 18 outputs the maximum value of its measurement range when the sheet 1 is conveyed too far from the guide plate 9 or when the sheet is no longer present when the rear edge has run past. The analog measured values from the ultrasonic sensor 18 are digitized in the analog-digital converter 30 and stored in the computer 25. As soon as the signal "evaluate measured values" is at a low level, the signal "regulation active" is output. A control algorithm then runs in the computer 25, wherein a characteristic value for the sheet length over the guide plate 9 is determined from the measured values stored in the measuring window 36. According to the algorithm, the n smallest measured values are found and averaged. In order to achieve a high accuracy, typically 10 to 50 measured values are used, which can be weighted if required. The characteristic value is compared with the intended value for the position of the sheet 1 above the guide plate 9. The intended value depends on the material and the thickness of the sheet 1 and also on the printed image on the sheet 1 and is passed to the computer 25 via the transmitter 33. Actuating signals for the blast air system 32 are derived from the difference between intended value and characteristic value. The control algorithm used forms a PID controller, with which the blast air is set such that the difference vanishes. As illustrated in FIG. 1, the blast air 12 acts against the circumferential surface 8. The flow velocity of the blast air 12 is higher than the circumferential speed of the circumferential surface 8. As a result of the acute inflow angle, the air flow 12 is applied to the circumferential surface 8. Between the guide plate 9 and the circumferential surface 8 there is a gap 37, which restricts the passage of the air flow 12. When the air flow 12 passes through the gap 37, a compressive action on the sheet 1 is then produced on the edge 38 of the guide plate, so that the sheet 1 does not smear on the edge 38 of the guide plate. The rough surface of the circumferential surface 8 benefits the application of the air flow 12 by means of thin turbulent flow layer.

If the blast air system 32 contains a plurality of blower pipes and/or blast air sources, then the blower pipes 10 can be supplied with blast air in a functional dependence. For instance, one blower pipe can form a carrier air cushion between guide plate 9 and sheet 1, while the second blower pipe 10, as shown in FIG. 1, produces an air flow 12 in the direction of the circumferential surface 8. By means of the combination of the blower pipes, an equilibrium between the actions of forces on the sheet 1 is established, so that a sheet 1 can be kept on a predefined path.

This application claims the priority, under 35 U.S.C. § 119 , of German patent application No. 10 2004 061 410.5 of Dec. 21, 2004; the prior application is herewith incorporated by reference in its entirety.

We claim:

1. A method for the cyclic conveyance of sheets through a printing machine, the method which comprises:

holding the sheets, following one another, at a front edge thereof in grippers of a gripper system during the conveyance;

acquiring a multiplicity of, temporally sequential, measured position values of a sheet running past at least one sensor;

inputting the measured position values into a control device and determining from the measured position values a characteristic value for the sheet position;

defining the characteristic value as an actual value, and comparing the actual value with a predefined setpoint value to form a comparison result; and adjusting a sheet position of a following sheet by actuating a pneumatic apparatus as a function of the comparison result relating to a respectively preceding sheet.

2. The method according to claim 1, which comprises using the measured position values of a plurality of sheets following one another to determine the characteristic value.

3. The method according to claim 1, which comprises measuring the measured position values in a predefined region at a trailing rear edge of a sheet.

4. The method according to claim 3, wherein the region at the rear edge of the sheet is derived from a signal from the sensor.

5. The method according to claim 1, which comprises deriving a time interval within which the measured position values are used to determine the characteristic value from a magnitude of the measured position values themselves.

6. The method according to claim 1, which comprises averaging a number n of smallest measured position values for determining the characteristic value for the sheet position.

7. The method according to claim 1, which comprises, in determining the characteristic value for the sheet position, checking the measured position values for plausibility.

8. The method according to claim 1, which comprises initializing the pneumatic apparatus with a preset characteristic curve containing operating points that reproduce a dependence of the blast air on the characteristic value and that have previously been determined empirically for a limited range of machine settings and printing materials, and correcting the preset characteristic curve by way of the characteristic values derived from the measured position values.

9. The method according to claim 1, which comprises acquiring the measured values with an ultrasonic sensor.

10. The method according to claim 1, which comprises acquiring the measured values with an optical sensor.

11. The method according to claim 1, which comprises calibrating the sensor by utilizing measured values recorded from a surface of the gripper system.

* * * * *